United States Patent [19]

Tomlinson

[11] Patent Number: 4,982,785

[45] Date of Patent: Jan. 8, 1991

[54] SERPENTINE HEAT EXCHANGER

[75] Inventor: Ronald S. Tomlinson, Mt. Juliet, Tenn.

[73] Assignee: Inter-City Products Corporation (USA), Lavergne, Tenn.

[21] Appl. No.: 489,461

[22] Filed: Mar. 6, 1990

[51] Int. Cl.[5] ..... F28F 3/12

[52] U.S. Cl. ..... 165/170; 165/174; 165/81; 126/110 R

[58] Field of Search ..... 126/99 R, 110 R, 116 R; 165/81, 170, 174, 166

[56] References Cited

U.S. PATENT DOCUMENTS

| | | | |
|---|---|---|---|
| 700,575 | 5/1902 | Thompson | 220/689 |
| 1,015,404 | 1/1912 | Schewczik | 165/170 |
| 1,072,512 | 9/1913 | Schewczik | 165/170 |
| 1,158,576 | 11/1915 | Sonneborn | 126/119 |
| 1,286,483 | 12/1918 | Singer | 352/160 |
| 1,443,189 | 1/1923 | Milm | 165/170 |
| 1,803,764 | 5/1931 | Miller | 165/56 |
| 1,805,652 | 5/1931 | Caracristi | 165/166 |
| 1,965,102 | 7/1934 | Jerome | 165/139 |
| 2,043,496 | 6/1936 | Schneider | 62/515 |
| 2,276,400 | 3/1942 | Hubbard | 165/122 |
| 2,391,028 | 12/1945 | Miles | 126/99 R |
| 2,496,505 | 2/1950 | Thompson | 126/110 R |
| 2,550,174 | 4/1951 | Towner | 29/890.35 |
| 2,715,399 | 8/1955 | Witt et al. | 126/110 R |
| 2,763,260 | 9/1956 | Eichorn | 126/99 R |
| 3,311,155 | 3/1967 | Hershey et al. | 431/114 |
| 3,399,661 | 9/1968 | Kreis | 126/116 R |
| 3,638,636 | 2/1972 | Marshall et al. | 126/110 R |
| 3,661,140 | 5/1972 | Raleigh | 126/110 R |
| 3,807,382 | 4/1974 | Kennedy | 126/116 R |
| 4,131,980 | 1/1979 | Zinnbauer | 29/463 |
| 4,209,064 | 6/1980 | Cacalloro et al. | 165/130 |
| 4,256,082 | 3/1981 | Scholten et al. | 126/110 AA |
| 4,298,061 | 11/1981 | Hoeffken | 165/170 |
| 4,441,241 | 4/1984 | Hoeffken | 29/890.03 |
| 4,467,780 | 8/1984 | Ripka | 126/110 R |
| 4,510,660 | 4/1985 | Hoeffken | 165/170 X |
| 4,739,746 | 4/1988 | Tomlinson | 126/110 R |
| 4,779,676 | 10/1988 | Harrigill | 165/170 |
| 4,800,954 | 1/1989 | Noguchi et al. | 165/153 |
| 4,848,314 | 7/1989 | Bentley | 126/116 R |

*Primary Examiner*—Martin P. Schwadron
*Assistant Examiner*—Allen J. Flanigan
*Attorney, Agent, or Firm*—Jeffers, Hoffman & Niewyk

[57] ABSTRACT

The present invention is an improved serpentine heat exchanger. Two metal sheets are crimped together, sealed at their abutting edges. The sheets have matching depressions which from a serpentine air passageway. Within the passageway are elongated ribs and column like dimples which serve as obstruction to the air flow, directing fluid flow over under-utilized portions of the passageway and generating turbulent fluid flow near heat transfer surfaces.

13 Claims, 4 Drawing Sheets

SERPENTINE HEAT EXCHANGER

BACKGROUND OF THE INVENTION

The field of the invention is that of heat exchangers, and more particularly, heat exchangers for use in domestic furnaces.

In one prior art form of a conventional domestic furnace, air to be heated (room air) is circulated around a serpentine heat exchanger for heat transfer to the conditioned room air. The heat exchanger defines a passageway for the flow of hot combustion gases conventionally produced by burning a fuel such as oil, gas, etc. The hot products of combustion pass through the heat exchanger thereby transferring heat to the conditioned room air, which is exhausted through a suitable flue.

To facilitate the heat transfer, heat exchangers preferably cause a turbulent flow within the fluid streams which exchange heat. Turbulent flow is achieved by superimposing an unsteady fluctuating velocity distribution on a steady mean flow pattern. By providing such a steady mean flow pattern, i.e. an average rate of flow, the furnace can reliably maintain air intake and exhaust. By superimposing an unsteady fluctuating velocity distribution, i.e. shifting subcurrents, on the steady flow pattern, the fluid stream transfers heat through the interface media of the walls of the heat exchanger. Providing a sufficiently turbulent flow assures that the fluid streams interact properly with the interface media for the efficient exchange of heat. However, turbulence also creates stress on the heat exchanger structure. Thus, it is desirable to provide a structurally secure heat exchanger which provides a sufficiently turbulent flow to assure proper functioning of the heat exchanger.

Heat exchangers are classified by the relative direction of the fluid streams which exchange heat. With aligned fluid flow channels, the streams run either parallel or counterflow. Streams with a parallel flow orientation are those which flow in relatively the same direction. Streams with a counterflow orientation travel in relatively opposite directions. With the fluid flow channels positioned relatively transversely, the streams flow with a cross flow orientation. Counterflow represents the most efficient method of transferring heat within a heat exchanger since it assures the greatest temperature differential between the heat exchanging fluid streams.

To most efficiently utilize a furnace, the heat transfer from the combustion products to the conditioned room air is maximized. A serpentine heat exchanger is conventionally used to continuously increase the temperature of the conditioned room air as it flows over the heat transfer surfaces of the heat exchanger. When disposed in a counterflow orientation, conventional heat exchangers maximize their heat transfer efficiency, although certain installations require a more uniform, albeit somewhat less efficient, distribution of heat transfer.

U.S. Pat. No. 4,739,746 (Tomlinson) describes a furnace having a serpentine heat exchanger for selectively providing either a parallel or counterflow heat transfer arrangement. Although the serpentine heat exchanger of the Tomlinson patent provides improved selective functioning, the increasing cost of fuel for furnaces creates a need for heat exchangers which have greater efficiencies in order to minimize heating costs. However, conventional designs do not effectively employ the full advantage of the heat transfer surfaces. Thus what is needed is a heat exchanger which fully utilizes the potential heat transfer surfaces of the heat exchanger.

SUMMARY OF THE INVENTION

The present invention is an improved serpentine heat exchanger. The passageway of the serpentine heat exchanger has a contour which provides improved heat transfer characteristics. Specifically, elongated ribs and column-like dimples extending within the passageway direct flow onto heat transfer surfaces to increase the efficiency of heat transfer. The heat exchanger is securely crimped together at its edges, while eyelets located located in the interior of the passageway secure together plates and preserve the integrity of the passageway.

Also, the serpentine heat exchanger has a contour which provides counterflow heat transfer segments within the passageway. To minimize combustion problems, the first segment of the serpentine passageway is initially straight and has a cross flow orientation with respect to the flow of room air. After the initial segment, the passageway bends and the remaining segments have a parallel or counterflow orientation. The orientation of the present invention provides a greater heat transfer efficiency, having segments with true counterflow heat exchange.

The present invention, in one form, is a heat exchanger for a domestic furnace. In a furnace having a burner for providing hot products of combustion, and a blower for circulating conditioned air, the heat exchanger transfers heat from the products of combustion to the conditioned air using two clamshell plates assembled together which define a serpentine passageway. The plates are interconnected at their edges by crimping, except at the portals of the passageway. Depressions in the plate form the passageway and, near the second portal, elongated ribs extend from the plate into the passageway to generate a turbulent fluid flow.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
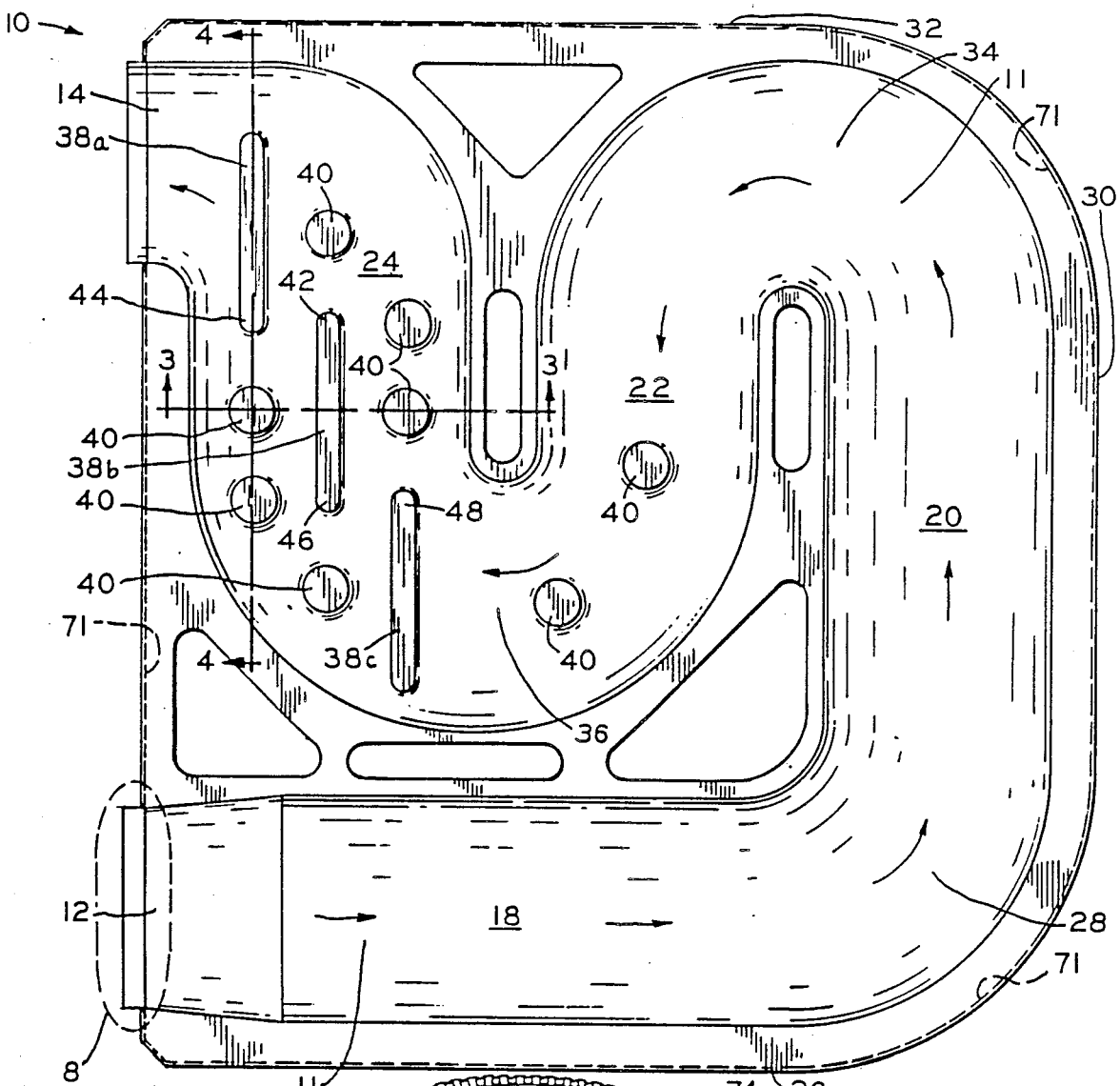
FIG. 1 is a top plan view of a heat exchanger clamshell plate of the present invention.

Corresponding reference characters indicate corresponding parts throughout the several views. The exemplifications set out herein illustrate embodiments of the invention, in forms thereof, and such exemplifications are not to be construed as limiting the scope of the disclosure or the scope of the invention in any manner.

DESCRIPTION OF THE PREFERRED EMBODIMENT

The shape of the passageway of the present invention is shown in FIG. 1. Serpentine heat exchanger clamshell plate 10 has a depression 11 which, in combination with a depression of a matching plate, defines inlet portal 12, exhaust portal 14, and passageway 16 that connects portals 12 and 14.

Passageway 16 is comprised of various segments, including inlet channel 18, parallel flow channel 20, counterflow channel 22, and turbulence channel 24. Inlet channel 18 extends straight from inlet portal 12 along lower edge 26 to bend 28 near peripheral edge 30. At bend 28, passageway 16 continues through parallel flow channel 20 which extends upwardly along peripheral edge 30. Parallel channel 20 extends up to upper edge 32, where it forms part of U-turn 34. Counterflow channel 22 extends from U-turn 34 to U-turn 36, from upper edge 32 downwardly towards inlet channel 18. Completing passageway 16 from U-turn 36 to exhaust portal 14 is turbulence channel 24, which contains both ribs 38 and dimples 40. Thus, parallel channel 20, counterflow channel 22 and turbulence channel 24 define an "S" shaped passageway for products of combustion ending in exhaust portal 14. Inlet channel 18 connects inlet portal 12 with one end of the "S" at bend 28.

The serpentine heat exchanger is used within a furnace, with its portals 12 and 14 connected to the heating system. For example, one configuration of such a furnace has a burner placed within inlet channel 18; near exhaust portal 14 a blower induces a draft within passageway 16 so that the burner is assured of a fresh flow of combustion gases. To circulate conditioned air within the building being heated, another blower causes conditioned air to flow over the exterior of the serpentine heat exchanger.

As disposed within a furnace, room air passes over plate 10 in a direction from lower edge 26 to upper edge 32. Assuming the products of combustion flow from inlet portal 12 to exhaust portal 14, products of combustion flowing through inlet channel 18 have a cross flow orientation relative to the conditioned room air. Subsequent flow through parallel flow channel 20 and counterflow channel 22 has a parallel flow and counterflow orientation, respectively, relative to the room air flow. In turbulence channel 24, the flow of the products of combustion is generally parallel to the room air flow, but the addition of ribs 38 and dimples 40 disrupts the uniformity of the fluid flow and causes the flow to be turbulent rather than laminar. Turbulent flow results in more efficient heat transfer to the room air.

Alternately, if exhaust portal 14 is positioned below inlet portal 12, and conditioned air then passes over plate 10 in a direction from edge 32 to edge 26, channels 20 and 24 have a counterflow orientation, while channel 22 has a parallel flow orientation.

Figure 3:
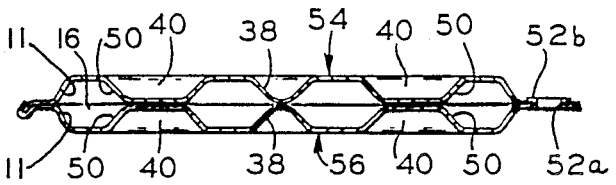
FIG. 3 is a cross sectional view of an assembled heat exchanger taken along lines 3—3 of FIG. 1.
Figure 4:
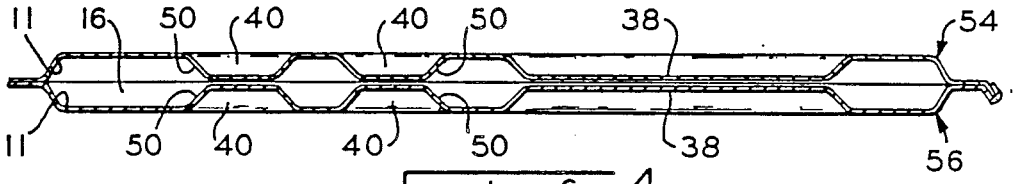
FIG. 4 is a cross sectional view of an assembled heat exchanger taken along lines 4—4 of FIG. 1.
Figure 5:
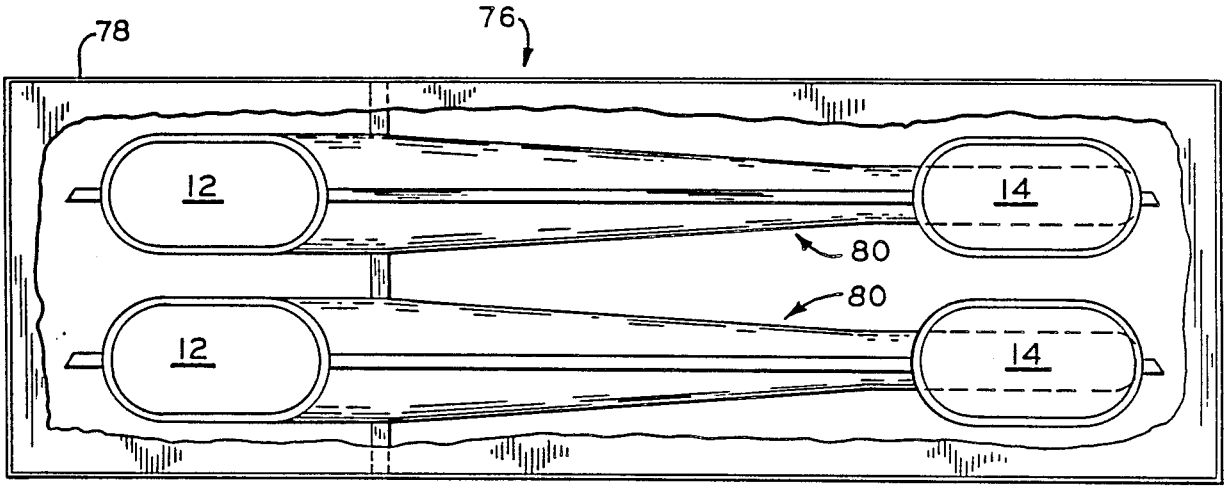
FIG. 5 is a front view in partial cut-away of a bank of heat exchangers according to the present invention.

The interior surfaces of the channels which comprise passageway 16 have a rounded rectangular cross sectional area, as can be seen in FIGS. 3 and 4. As shown in FIG. 5, the height of passageway 16 within assembly 80 is greater near inlet portal 12 than near exhaust portal 14. This decreasing depth without a corresponding increase in width produces a venturi effect in counterflow channel 22 and more so in turbulence channel 24. Thus, the increased flow velocity which occurs in counterflow channel 22 and turbulence channel 24 aids in increasing the efficiency of heat transfer in the heat exchanger.

Ribs 38 help create turbulence to facilitate heat transfer, as each rib 38 is comprised of an elongated indentation extending into passageway 16 (see FIG. 4). In the preferred embodiment of the present invention, three ribs 38 are positioned within turbulence channel 24. On each plate 10, ribs 38 extend from turbulence channel 24 to near the plane defined by the interior surfaces of plate 10. Matching ribs 38 from matching plates 10 have only a marginal space between their ends, and can directly abut to form a wall-like obstruction to air flow. Ribs 38 are arranged to be generally vertically parallel to each other and spaced apart by a relatively short distance or in an abutting position, middle rib 38*b* having a top end 42 horizontally aligned with a bottom end 44 of outer rib 38*a*, and a bottom end 46 of rib 38*b* horizontally aligned with top end 48 of inner rib 38*c*. With this configuration of ribs 38, the channel 24 between counterflow channel 22 and exhaust portal 14 is partially obstructed, which promotes turbulence. Thus, products of combustion traversing turbulence channel 24 must circulate around ribs 38, diverting those products of combustion onto heat transfer surfaces which improves the heat transfer efficiency.

Also, dimples 40 extend into passageway 16, to compound the turbulence caused by ribs 38. Each annular dimple extension 50 extends and nearly meets a corresponding annular dimple extension 50 of its matching plate. The ends of dimple extensions 50 are connected together by eyelets 52 formed directly in plates 10 as further explained hereinafter. Being cylindrical in shape and securely connected together, matching dimple extensions 50 form column like obstructions within passageway 16. The column like obstructions of passageway 16 cause additional turbulence, while the secure fastening of eyelets 52 serves to preserve the structural integrity of the serpentine heat exchanger.

Figure 6:
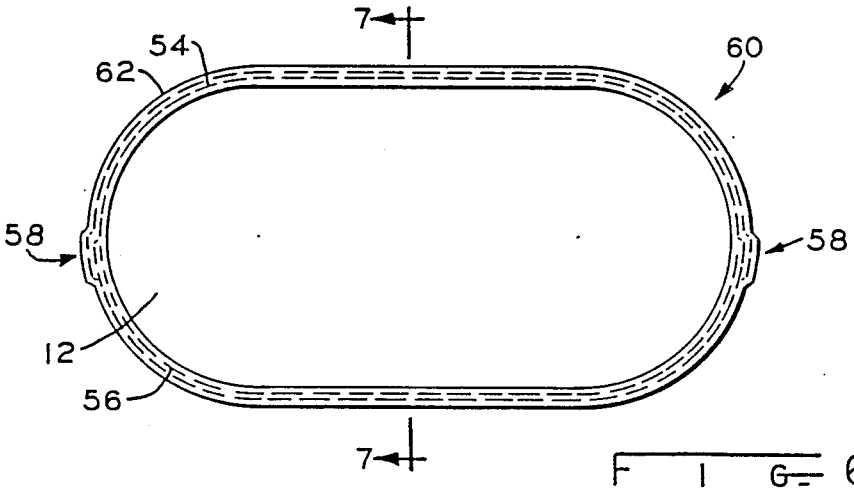
FIG. 6 is an enlarged front sectional view of a passageway portal of an assembled heat exchanger.
Figure 7:
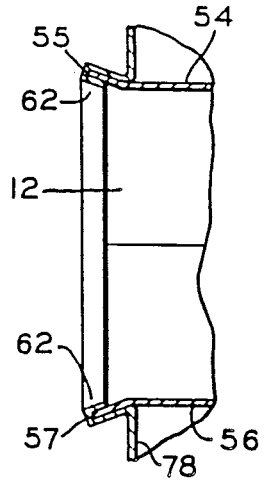
FIG. 7 is a cross sectional view of the passageway portal taken along lines 7—7 of FIG. 6.
Figure 8:
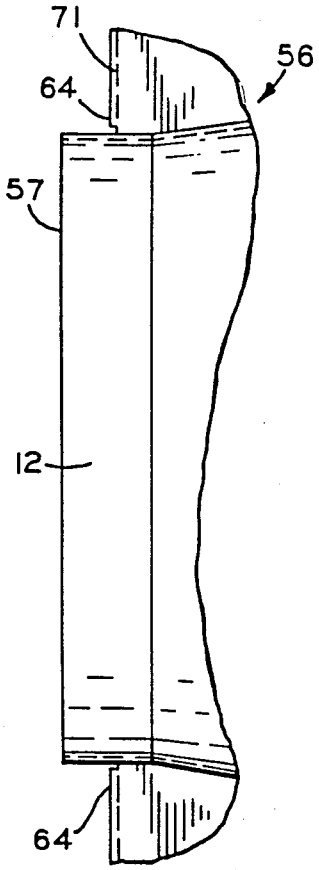
FIG. 8 is an enlarged fragmentary view of one plate which forms the passageway portal taken in region 8 of FIG. 1.
Figure 10:
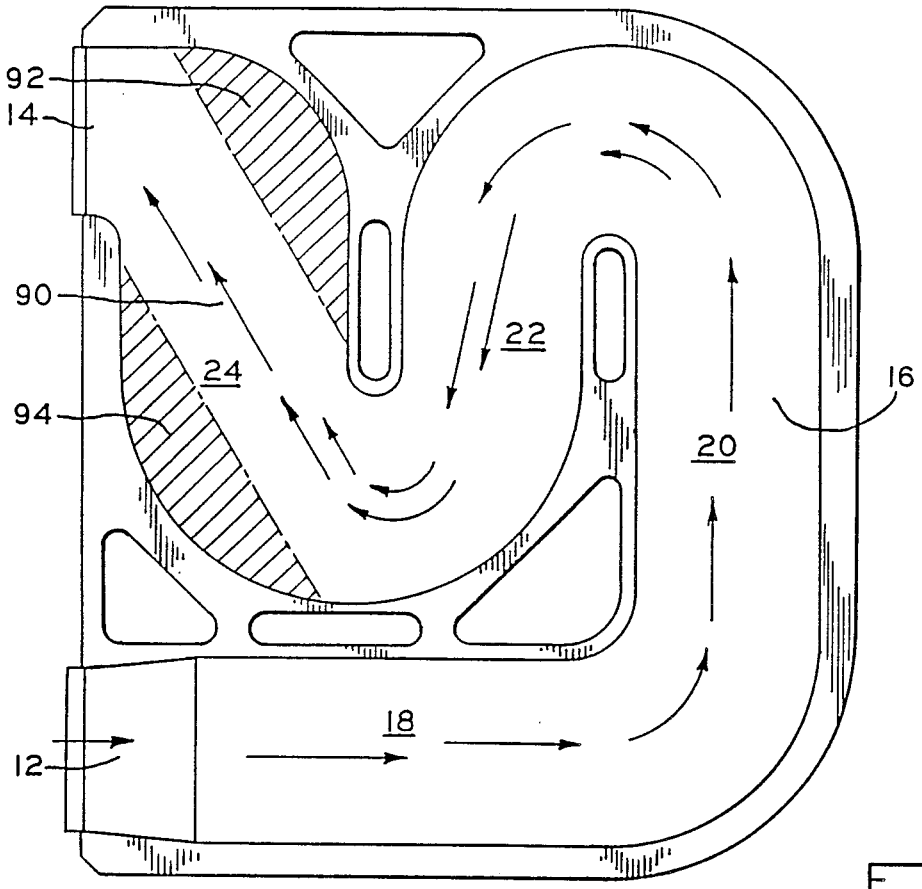
FIGS. 10 and 11 are schematic diagrams of air flow within the serpentine passageway without ribs and with ribs, respectively.
Figure 11:
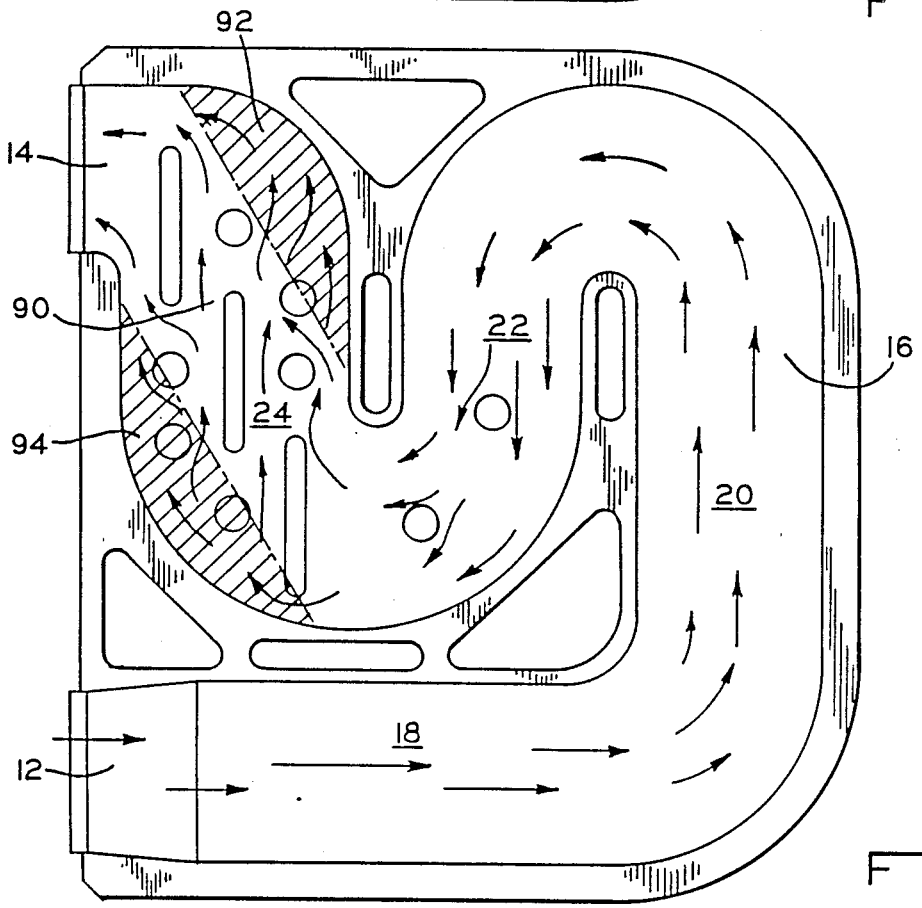

Passageway 16 terminates at inlet and exhaust portals 12 and 14, respectively, which are shown in greater detail in FIGS. 6, 7 and 8. Upper plate segment 54 and lower plate segment 56 join at crimping locations 58 to form portal 12, which represents the structure of either portal 12 or 14 in FIGS. 7 and 8. Wrapped around portal 12 to secure it is lip 62 which facilitates connection to a furnace. As seen in FIG. 7, the portal edges 55 and 57 of plate segments 54 and 56, respectively, flange outwardly from portal 12. Also, portal 12 extends beyond connecting edge 64 (FIGS. 1, 7, and 8).

Figure 2:
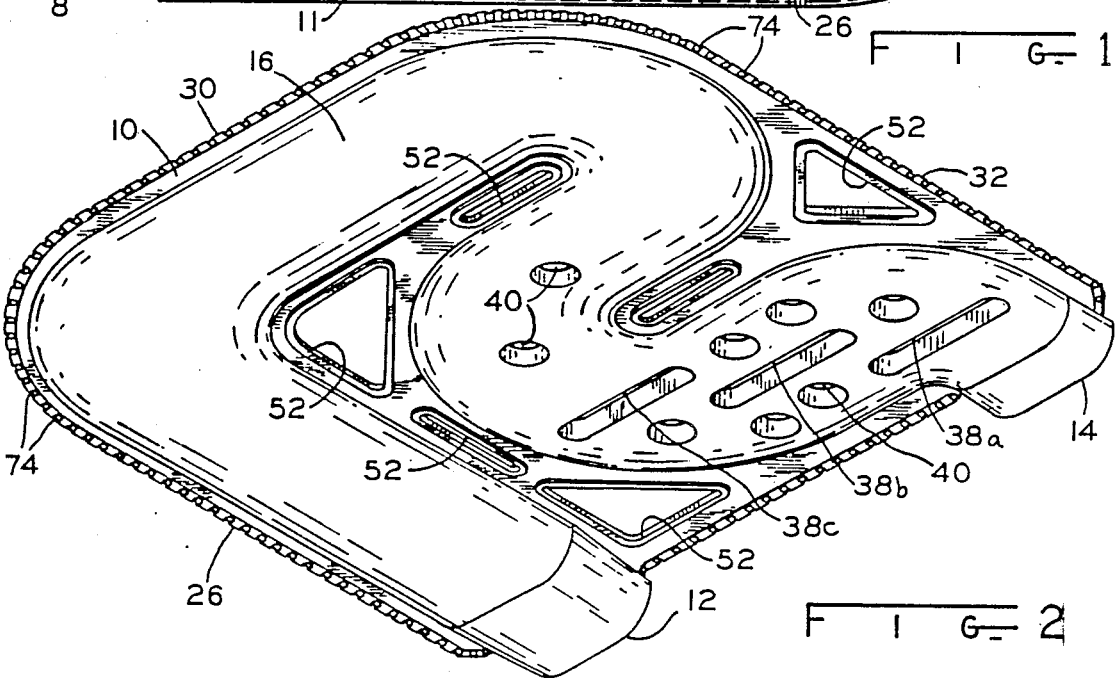
FIG. 2 is a perspective view of the heat exchanger clamshell plate of FIG. 1.

The plates of the serpentine heat exchanger are connected together by eyelets 52 within the edges of plate 10 and by crimping along the edges of plate 10. Eyelets 52 can be seen in perspective in FIG. 2, and in a sectional view in FIG. 3. Each eyelet 52 comprises interior edge portions of plate 10, matching receiving holes and collars from matched plates 10. One of the matched plates has a pierced receiving hole 52*a* and the other has an extrudent upwardly projecting collar 52*b*. Collar 52*b* initially has an outer diameter less than the inner diameter of hole 52*a* and thus extends through its matching receiving hole 52*a*; then collar 52*b* is peened or hemmed over the edges of hole 52*a* to fasten collar 52*b* about hole 52*a*. Thus, interior points of plate 10 are connected to a corresponding plate without welding or other forms of coupling which are more subject to breakage due to thermal stresses.

Figure 9:
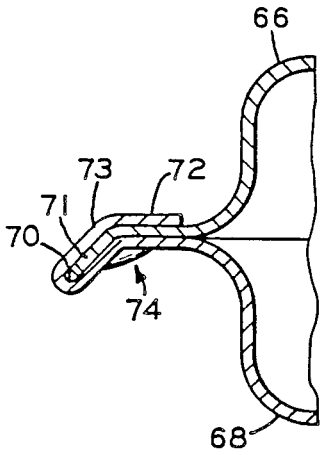
FIG. 9 is a sectional view of the crimped edges of two heat exchanger clamshell plates.

Along edges 26, 30, 32, and 64, matching plates which form the serpentine heat exchanger are bent and crimped together to provide a secure seal. FIG. 9 shows a sectional view of a top plate 66 and a bottom plate 68 joined together by crimping at an edge. The end of top plate 66 extends outwardly and bends downwardly to project from the crimping edge 71. The bend near the end of top plate 66 is, in the preferred embodiment, approximately 45°. Bottom plate 68 is wrapped around top plate 66, and a gap 70 exists between plates 66 and 68 where bottom plate 68 wraps over top plate 66. Gap 70 allows the metal of top plate 66 to expand without adversely effecting the coupling, so top plate 66 does not press against bottom plate 68. Thus, changing temperature conditions which cause top plate 66 to expand do not cause it to alter the position of bottom plate 68.

Also in the preferred embodiment, after wrapping bottom plate 68 over top plate 66, a perforation crimping is applied on top surface 72 of wrapped around portion or fold 73 of bottom plate 68. The gap 70 (FIG. 9) and the perforated crimping edge 71 (FIG. 1) on top surface 72 form a gusset 74 which maintains a seal between the two metal plates. The gussets 74, preferably evently spaced, actually stretch the plate material to make the juncture tight from one end to the other, which also helps to maintain a seal. This bending and crimping helps to break the material and make a good end seal.

A number of serpentine heat exchangers may be combined to form a serpentine heat exchanger bank 76, as shown in FIG. 5. Case 78 houses a plurality of heat exchanger assemblies 80, with FIG. 5 depicting two assemblies 80 within case 78. Lip 62 may be formed as part of case 78, integrally forming couplings to a furnace. A furnace compatible with serpentine heat exchanger bank 76 is described in U.S. Pat. No. 4,739,746, which is incorporated herein by reference. When installed in a furnace, the inlet portals 12 of assemblies 80 are connected to burners while exhaust portals 14 are coupled to a blower. Products of combustion pass through passageways 16 within assemblies 80, while room air circulates around assemblies 80 within case 78.

The plates 10 of the heat exchanger assemblies 80 may be comprised of corrosion resistant metallic materials, such as aluminized steel, 409 stainless steel, or a coated metal material. In the preferred embodiment, stainless steel is used.

While this invention has been described as having a preferred design, it can be further modified within the teachings of this disclosure. This application is therefore intended to cover any variations, uses, or adaptations of the invention following its general principles. This application is also intended to cover departures from the present disclosure as come within known or customary practice in the art to which this invention pertains and fall within the limits of the appended claims.

What is claimed is:

1. For use in a furnace having a burner means for providing hot products of combustion, and an air flow means for circulating conditioned air, a heat exchanger for transferring heat from products of combustion to conditioned air, said heat exchanger comprised of first and second matched clamshell plates assembled together, said plates connected at their respective edges by a sealing means for providing a seal thereat, each said plate having an internal surface defining a depression, said depressions together defining a serpentine passageway, an entrance and exhaust ported formed in said passageway, said surfaces including elongated ribs for obstructing fluid flow adjacent said exhaust portal and for directing fluid flow to under-utilized portions in said passageway.

2. The heat exchanger of claim 1 wherein said sealing means comprises a flange portion of said first plate and a flange portion of said second plate, said second plate flange portion bent around said first plate flange portion to define a gap therebetween an end of said first plate flange portion and a fold of said second plate flange portion to thereby allow said first plate flange portion to expand or contract without substantially adversely altering said seal between said first and second plates.

3. The heat exchanger of claim 2 further comprising a lip wrapped around edges of said portals to secure said portals and facilitate coupling said heat exchanger to a furnace.

4. The heat exchanger of claim 1 wherein said surfaces also include column-like dimples located within said passageway.

5. The heat exchanger of claim 4 wherein said dimples comprise first and second dimple extensions, said dimple extensions matched together in an adjacent relation to create a column-like structure in said passageway.

6. The heat exchanger of claim 1 wherein said portals of said serpentine passageway are located along a common edge of said matched plates.

7. The heat exchanger of claim 1 wherein said serpentine passageway has a shape including a straight inlet channel at said first portal, a bend extending from said inlet channel, a parallel flow channel extending from said bend, a first U-turn extending from said parallel flow channel, a counterflow channel extending from said first U-turn, a second U-turn extending from said counterflow channel, and a turbulence channel extending from said second U-turn and terminating at said second portal.

8. The heat exchanger of claim 1 wherein said depressions decrease in depth from adjacent said entrance portal to adjacent said exhaust portal.

9. The heat exchanger of claim 1 wherein one of said first and second plates have receiving holes not located in said depression, the other of said first and second plates having matching upwardly extending collars, said plates secured together by hemming said collar about said receiving aperture to create an eyelet.

10. For use in a furnace having a burner means for providing hot products of combustion, and an air flow means for circulating conditioned air, a heat exchanger for transferring heat from products of combustion to conditioned air, said heat exchanger comprising:

first and second clamshell plates assembled together, each said plate having an internal surface defining a depression, said depressions defining a serpentine passageway therebetween, said passageway having an entrance portal and an exhaust portal, said passageway decreasing in depth from adjacent said entrance portal to adjacent said exhaust portal;

sealing means for providing a seal to connect said first and second plates, said sealing means comprising a flange portion of said first plate and a flange portion of said second plate, said second plate flange portion bent around said first plate flange portion to define a gap between an end of said first plate flange portion and a fold of said second plate flange portion to thereby allow said first plate flange portion to expand or contract without substantially adversely altering said seal between said first and second plates;

elongated ribs extending into said passageway near said exhaust portal for obstructing fluid flow near said exhaust portal thereby directing fluid flow to under-utilized portions in said passageway; and dimples having a column-like shape extending between said first and second plates for generating turbulent fluid flow.

11. The heat exchanger of claim 10 wherein said dimples include first and second dimple extensions of said first and second plate, respectively, said dimple extensions matched together in an adjacent relation to create a column-like structure in said passageway.

12. The heat exchanger of claim 10 wherein both said portals of said passageway are located along a common edge of said plates, and wherein said passageway has a shape including a straight inlet channel at said first portal, a bend extending from said inlet channel, a parallel flow channel extending from said bend, a first U-turn extending from said parallel flow channel, a counterflow channel extending from said first U-turn, a second U-turn extending from said counterflow channel, and a turbulence channel extending from said second U-turn and terminating at said second portal.

13. The heat exchanger of claim 10 wherein one of said first and second plates have receiving holes not located in said surfaces, the other of said first and second plates having matching upwardly extending collars, said plates secured together by hemming said collar about said receiving hole to create an eyelet.

* * * * *

UNITED STATES PATENT AND TRADEMARK OFFICE

CERTIFICATE OF CORRECTION

PATENT NO. : 4,982,785

DATED : January 8, 1991

INVENTOR(S) : Ronald S. Tomlinson

It is certified that error appears in the above-identified patent and that said Letters Patent is hereby corrected as shown below:

Line 4, delete "from" and substitute therefor --form--.

Claim 1, column 6, line 6, delete "ported" and substitute therefor --portal--.

Signed and Sealed this

Thirtieth Day of June, 1992

*Attest:*

DOUGLAS B. COMER

*Attesting Officer*

*Acting Commissioner of Patents and Trademarks*